United States Patent [19]

Weber

[11] Patent Number: 4,800,736

[45] Date of Patent: Jan. 31, 1989

[54] HEAT PUMP

[76] Inventor: Russell L. Weber, 864 Pebblefield, Manchester, Mo. 63021

[21] Appl. No.: 149,133

[22] Filed: Jan. 27, 1988

[51] Int. Cl.[4] ..... F25B 13/00

[52] U.S. Cl. ..... 62/324.1; 62/84; 62/194; 62/470; 62/471

[58] Field of Search ..... 62/468, 470, 324.1, 62/324.6, 471, 84, 194

[56] References Cited

U.S. PATENT DOCUMENTS

| | | | |
|---|---|---|---|
| 2,749,723 | 6/1956 | Webber | 62/470 |
| 3,276,215 | 10/1966 | McDonell | 62/84 |
| 3,636,723 | 1/1972 | Kramer | 62/197 |
| 4,429,544 | 2/1984 | McCarty | 62/471 X |
| 4,563,879 | 1/1986 | Hama et al. | 62/324.1 X |

*Primary Examiner*—Lloyd L. King

*Attorney, Agent, or Firm*—Senniger, Powers, Leavitt and Roedel

[57] ABSTRACT

A heat pump having reversible heating and cooling cycles for circulating a refrigerant therein for adding heat to and removing heat from space, the heat pump comprising a heat exchanger for adding heat to and removing heat from air passed over it, a condenser-/evaporator coil for removing heat from or adding heat to refrigerant; and a compressor for circulating refrigerant. The heat pump further comprises a conduit for conducting refrigerant to the heat exchanger during the heating cycle and conducting refrigerant from the heat exchanger during the cooling cycle. A first line supplies the conduit with refrigerant during the heating cycle and is smaller than the conduit so that the refrigerant decelerates, causing oil that may have been picked up by the refrigerant to drop out. A second line also conducts refrigerant from the conduit during the cooling cycle. This line is larger than the conduit so that the refrigerant decelerates during, causing oil that may have been picked up by the refrigerant to drop out. A oil scavenging capillary returns oil removed in the conduit to the compressor.

7 Claims, 4 Drawing Sheets

HEAT PUMP

BACKGROUND OF THE INVENTION

This invention relates to heat pumps, and in particular to an improvement in the construction of reversible heat pumps of the type that circulate a refrigerant in separate heating and cooling cycles to transfer heat to or from space.

A heat pump is a device that extracts heat from a low temperature source and makes it available as useful heat at a higher temperature. Experimental heat pumps were constructed as early as the mid 1920's, and shortly thereafter heat pumps were used for heating applications. Eventually, heat pumps were developed that were basically reversible air conditioners, having reversible cycles for circulating a refrigerant to selectively transfer heat to or from space. These heat pumps typically comprise a heat exchanger for the addition of or removal of heat from the air forced over it by conducting heat to or from refrigerant circulating therein; a condenser/evaporator coil for the addition of or removal of heat from the refrigerant, and a compressor for circulating the refrigerant through an expansion device. The gas discharge of the compressor is connected to a reversing valve. The reversing valve is connected to the heat exchanger, the condenser-/evaporator coil, and the compressor suction gas inlet. The heat exchanger and the condenser/evaporator coil are interconnected with at least one expansion device. In the heating cycle, the reversing valve directs refrigerant gas from the compressor discharge to the heat exchanger. The refrigerant transfers heat by loss to the air forced over the heat exchanger. The liquid refrigerant then passes through an expansion device where it is vaporized and on to the condenser/evaporator coil where the refrigerant absorbs heat. The refrigerant gas returns via the reversing valve to the compressor suction inlet. In the cooling cycle, the reversing valve directs refrigerant gas from the compressor discharge to the condenser/evaporator coil. The refrigerant loses heat to the condenser/evaporator coil and condenses. The liquid refrigerant then passes through an expansion device where it is vaporized and on to the heat exchanger where it absorbs heat from air forced over the heat exchanger. The refrigerant returns via the reversing valve to the compressor suction gas inlet.

In these heat pumps, the refrigerant is frequently contaminated by lubricating oil from the compressor. The presence of the oil impairs the heat transfer properties of the refrigerant, reducing the efficiency of the heat pump. Furthermore, the loss of lubricating oil from the compressor can potentially damage the compressor.

SUMMARY OF THE INVENTION

It is among the objects of the present invention to provide a heat pump of improved efficiency, and in particular to provide such a heat pump that removes contaminating lubricating oil from the refrigerant that otherwise would impair the heat transfer properties of the refrigerant. It is also among the objects of the present invention to provide such a heat pump that removes oil from the refrigerant in both the heating and cooling cycles. It is further among the objects of the present invention to return the recovered oil to the compressor, to help prevent damage to the compressor which could result from insufficient oil levels during varying load requirements.

Generally, the heat pump of the present invention comprises a heat exchanger coil adapted to add heat to air forced over it during the heating cycle and to remove heat from air forced over it during the cooling cycle, the heat exchanger coil having a circuit therein for the circulation of refrigerant therein. A first heat exchanger conduit is connected to one end of the heat exchanger circuit for conducting refrigerant from the heat exchanger during the heating cycle and for conducting refrigerant to the heat exchanger during the cooling cycle. A second heat exchanger conduit is connected to the other end of the heat exchanger circuit for conducting refrigerant to the heat exchanger during the heating cycle and for conducting refrigerant from the heat exchanger during the cooling cycle.

The heat pump of the present invention further comprises a compressor for circulating the refrigerant during both the heating and cooling cycles, the compressor having an inlet (suction) and an outlet (discharge). A first connector connects the outlet of the compressor to the second heat exchanger conduit during the heating cycle. The first connector is smaller than the second heat exchanger conduit so that the refrigerant decelerates as it passes from the first connector to the second heat exchanger conduit. A second connector connects the second heat exchanger conduit to the compressor inlet during the cooling cycle. The second connector is larger than the second heat exchanger conduit so that the refrigerant decelerates as it passes from the second heat exchanger conduit to the second connector. An oil scavenger capillary tube connects the second heat exchanger conduit to the compressor. The scavenger capillary tube returns oil to the compressor that is removed from the circulating refrigerant by the deceleration caused by the first or second connectors and the second heat exchanger conduit.

The heat pump further comprises a condenser-/evaporator coil adapted to add heat to refrigerant circulating therein during the heating cycle and to remove heat from refrigerant circulating therein during the cooling cycle. The condenser/evaporator coil has a circuit therein for circulating refrigerant therein, the circuit having first and second ports. During the heating cycle refrigerant enters the first port and exits the second port; during the cooling cycle refrigerant enters the second port and exits the first port. A third connector connects the first heat exchanger conduit to the first port of the condenser/evaporator coil to conduct liquid refrigerant from the first heat exchanger conduit to the condenser/evaporator coil during the heating cycle and to conduct liquid refrigerant from the condenser-/evaporator coil to the first heat exchanger conduit during the cooling cycle.

A fourth connector connects the second port of the condenser/evaporator to the compressor suction inlet during the heating cycle to conduct refrigerant gas from the condenser/evaporator to the compressor. A fifth connector connects the second port of the condenser/evaporator to the compressor discharge outlet during the cooling cycle to conduct refrigerant gas from the compressor to the con- denser/evaporator.

In contrast to the prior art heat pumps, a heat pump constructed according to the present invention incorporates a size increase in the line supplying refrigerant from the compressor to the heat exchanger during the heating cycle. This size change causes the refrigerant to decelerate, causing oil carried by the refrigerant to fall out. Also in contrast to the prior art heat pumps, a heat pump constructed according to the present invention incorporates a size increase in the line returning refrigerant from the heat exchanger to the compressor during the cooling cycle. This size change causes the refrigerant to decelerate, again causing oil carried by the refrigerant to fall out. The oil thus removed from the refrigerant collects in a low point in the second heat exchanger conduit where it is returned to the compressor by an oil scavenging capillary tube.

The heat pump of the present invention thus removes oil from the refrigerant that would otherwise circulate, impairing the heat transfer properties of the refrigerant, and thus operates more efficiently. Furthermore, this oil is removed during both the heating and cooling cycles. Finally, the device returns oil to the compressor, helping to maintain a sufficient oil supply to prevent damage to the compressor.

These and other advantages will be in part apparent and in part pointed out hereinafter.

BRIEF DESCRIPTION OF THE DRAWINGS

Corresponding reference numerals designate corresponding parts throughout the several views of the drawings.

DETAILED DESCRIPTION OF THE PREFERRED EMBODIMENT

Figure 1:
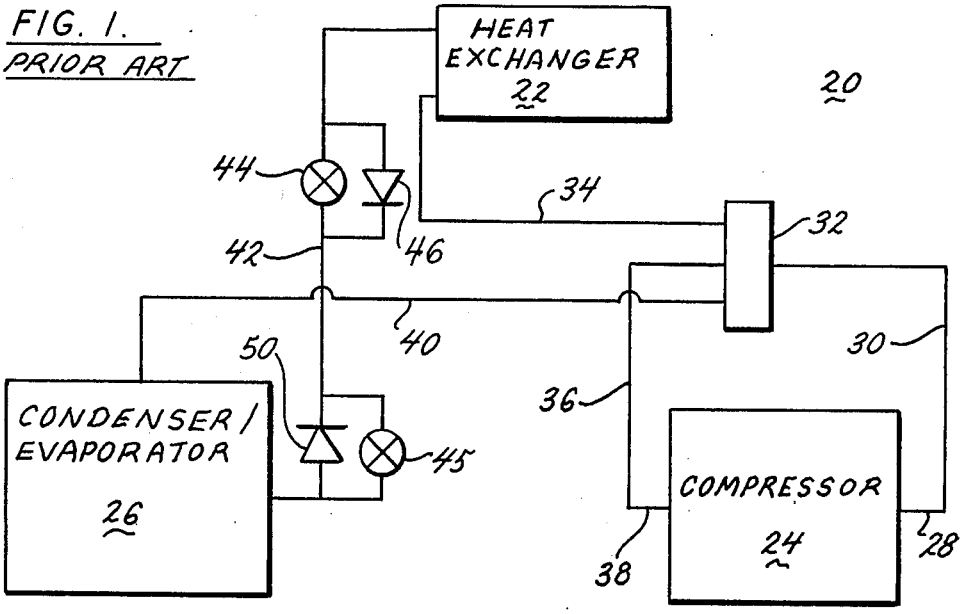
FIG. 1. PRIOR ART
FIG. 1 is a schematic diagram of a typical prior art heat pump.

A prior art heat pump, indicated generally as 20, is shown schematically in FIG. 1. Heat pump 20 comprises a heat exchanger 22 having a circuit therein for the circulation of a refrigerant to add heat to air forced over it during the heating cycle and to remove heat from air forced over it during the cooling cycle; a compressor 24, for circulating the refrigerant during the heating and cooling cycles; and a condenser/evaporator coil 26 for adding heat to the refrigerant during the heating cycle and removing heat from the refrigerant during the cooling cycle by transfer to an air or water heat source.

The outlet (discharge) 28 of compressor 24 is connected by connector 30 to a reversing valve 32. Three lines extend from the reversing valve 32. The first line 34 extends to the heat exchanger 22; the second line 36 extends to the inlet 38 of compressor 24; and the third line 40 extends to the condenser/evaporator 26. A connector 42 connects the heat exchanger 22 and the condenser/evaporator 26, and has a first expansion device 44 and check valve by-pass 46 therein and second expansion device 48 and check valve by pass 50 therein.

During the heating cycle, the first line 34 conducts high temperature, high pressure refrigerant gas supplied by the compressor 24 from the reversing valve 32 to the heat exchanger 22. The refrigerant gas circulates through the heat exchanger 22, giving up heat to the air forced over the heat exchanger 22 and condenses to a liquid. The refrigerant leaves the heat exchanger 22 through connector 42 bypasses expansion device 44 through check valve 46 and passes through expansion device 45 where it vaporizes and then passes on as a gas to the condenser/evaporator coil 26. The refrigerant gas circulates through the condenser/evaporator coil 26, absorbing additional heat. The refrigerant gas leaves the condenser/evaporator coil 26 through the third line 40, returning to back to the reversing valve 32, where it is channeled through second line 36 to the inlet 38 of compressor 24 where compression increases the temperature.

During the cooling cycle, the third line 40 conducts high temperature, high pressure refrigerant gas supplied by the compressor 34 from the reversing valve 32 to the condenser/evaporator coil 26. The refrigerant circulates through the condenser/evaporator coil 26, giving up heat and condensing to liquid. The liquid refrigerant is forced from the condenser/evaporator 26 through connector 42 and bypasses expansion device 48 through check valve 50 and passes through expansion device 44 where it vaporizes and then passes on as a subcooled gas to the heat exchanger 22. The refrigerant gas circulates through the heat exchanger 22, absorbing heat from air forced over the heat exchanger. The refrigerant gas leaves the heat exchanger 22 through the first line 34, returning to the reversing valve 32, where it is channeled through second line 36 to the inlet 38 of compressor 24.

Figure 2:
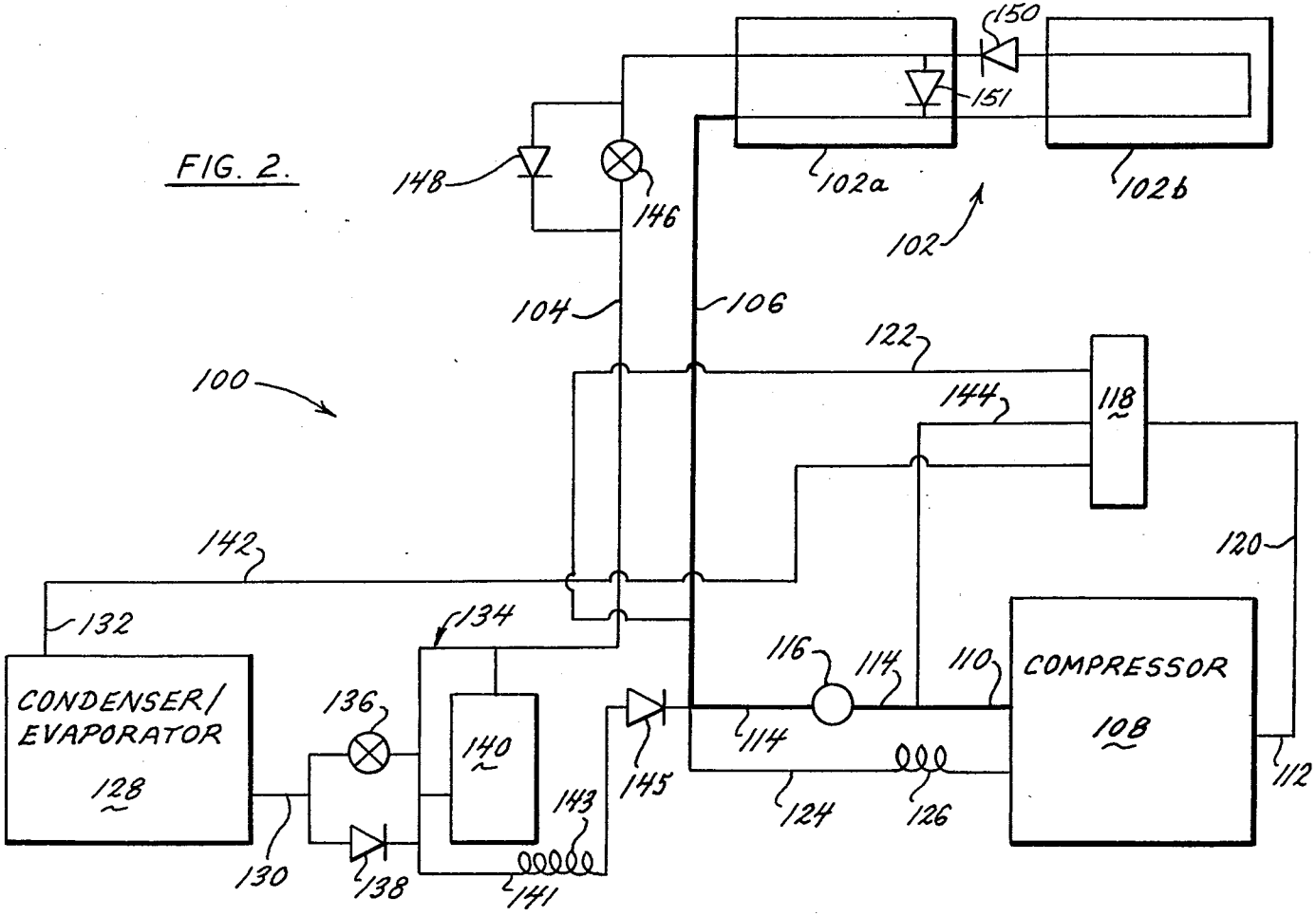
FIG. 2 is a schematic diagram of a heat pump constructed according to the principles of this invention.

A heat pump constructed according to the principles of the present invention, indicated generally as 100, is shown schematically in FIG. 2. This heat pump may be of the type using an outdoor air coil or an air to glycol coil as the heat source, or, preferably, of the type using a coil immersed in ground water or tap water as the heat source. The heat pump 100 comprises a heat exchanger 102 having a circuit therein for the circulation of a refrigerant to add heat to air forced over it during the heating cycle by conducting heat from the refrigerant circulating therein, and to remove heat from air forced over it during the cooling cycle by conducting heat to the refrigerant circulating therein. A first heat exchanger conduit 104 extends from one end of the heat exchanger circuit for conducting refrigerant from the heat exchanger 102 during the heating cycle and for conducting liquid refrigerant to the heat exchanger 102 during the cooling cycle. A second heat exchanger conduit 106 is connected to the other end of the heat exchanger circuit for conducting high temperature and pressure refrigerant gas to the heat exchanger 102 during the heating cycle and for conducting high temperature refrigerant gas from the heat exchanger 102 during the cooling cycle.

The heat pump 100 further comprises a compressor 108 for circulating the refrigerant during the heating and cooling cycles. The compressor 108 has an inlet (suction) 110 and an outlet (discharge) 112. A compressor inlet conduit 114 connects the compressor inlet 110 and the second heat exchanger conduit 106, to conduct low temperature low pressure refrigerant from the second heat exchanger conduit 106 to the compressor inlet 110 during the cooling cycle. The compressor inlet conduit 114 includes means for closing the conduit to block the passage of refrigerant during the heating cycle. In this preferred embodiment this closing means comprises a solenoid-operated valve 116. The compressor inlet 114 is larger than the second heat exchanger conduit 106 so that the refrigerant decelerates passing from the second heat exchanger conduit 106 to the compressor inlet 114. For example, the second heat exchanger conduit 106 might be sized at ¾ inch i.d. and the compressor inlet might be sized at 1 inch i.d. This deceleration causes oil that has been picked up by the refrigerant from the compressor to form droplets.

The heat pump 100 further comprises a reversing valve 118. A compressor outlet conduit 120 connects the compresser outlet 112 to the reversing valve 118, to conduct high temperature, high pressure refrigerant from the compressor 108 to the reversing valve 118. A first valve line 122 connects the reversing valve 118 to the second heat exchanger conduit 106, for conducting refrigerant gas from the compressor to the second heat exchanger conduit 106 during the heating cycle. The first valve line 122 is smaller than the second heat exchanger conduit 106 so that the refrigerant decelerates passing from the first valve line 122 to the second heat exchanger conduit 106. For example, the second heat exchanger conduit 106 might be sized at ¾ inch i.d. and the first valve line 122 might be sized at ½ inch i.d. As noted above, this deceleration causes oil that has been picked up by the refrigerant from the compressor to form droplets.

The oil removed from the refrigerant by the deceleration of the refrigerant passing from the first valve line 122 to the second heat exchanger conduit 106 during the heating cycle, and by the deceleration of the refrigerant passing from the second heat exchanger conduit 106 to the compressor inlet 114 during the cooling cycle, collects in a low point in second heat exchanger conduit 106. A first oil scavenger capillary 124 connects the second heat exchanger conduit 106 to the compressor 108, to return the collected oil to the compressor 108. The scavenger capillary has loops 126 which act as a trap to prevent refrigerant gas from passing through the capillary. The size of the capillary can be easily determined by a person of ordinary skill in the art. The capillaries may be sized at one-half the length of one-third the total horsepower per ton capacity in a system where the line sets are between 15 and 25 feet. The inventor has successfully used a Bullet Restricto Cap (tm) No. 5 restriction with at least two loops of 2" minimum diameter. The loops extend upwardly for the line.

The heat pump 100 further comprises a condenser-/evaporator coil 128 having a circuit therein for the circulation of refrigerant, to add heat to refrigerant circulating therein during the heating cycle and to remove heat from refrigerant circulating therein during the cooling cycle. As noted above the condenser-/evaporator coil 128 may be an outdoor air coil or air to glycol coil, or, preferably a coil that accepts and rejects heat to a water supply, such as tap water or well water. The refrigerant circuit of condenser/evaporator coil 128 has first and second ports, 130 and 132, respectively. During the heating cycle, refrigerant enters the first port 130 and exits the second port 132; during the cooling cycle refrigerant enters the second port 132 and exits the first port 130.

A line 134 connects the first heat exchanger conduit 104 to the first condenser port 130, to conduct liquid refrigerant from the first heat exchanger conduit 104 to the condenser/evaporator 128 during the heating cycle, and to conduct liquid refrigerant from the condenser-/evaporator 128 to the first heat exchanger conduit 104 during the cooling cycle. The line 134 preferably includes an expansion device 136 by-passed by a check valve 138 so that refrigerant passing from first heat exchanger conduit 104 to the condenser/evaporator 128 during the heating cycle passes through the expansion device 136, while liquid refrigerant passing in the opposite direction during the cooling cycle bypasses expansion device 136. A receiver 140 must also be provided in line 134.

Figure 6:
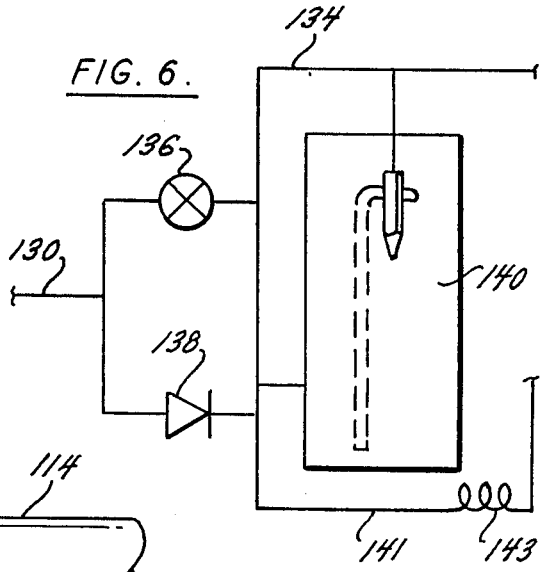
FIG. 6 is a view of the receiver.

The receiver 140 is best shown in FIG. 6. The receiver 140 is open during both the heating and cooling cycles. The receiver 140 stores excess refrigerant during light load conditions in either the heating or cooling cycles. Due to the parallel operation of receiver 140 with line 134, oil will drop out. Therefore, and oil scavenger line 141 is provided to return oil-rich liquid refrigerant to the second heat exchange conduit 106. The oil scavenger line 141 preferably has loops 143 therein, which act as a trap. The size of the capillary can be easily determined by a person of ordinary skill in the art. The inventor has successfully used a Bullet Restricto Cap (tm) No. 4 restrictors 4 feet long with 4 loops therein, having a diameter not greater than 1½ inches. The loops preferably extend upwardly from the line. There are more loops in capillary 141 than in capillary 124 because there is a greater pressure differential over the capillary 141. A check valve 145 is provided to eliminate reverse flow of oil to the receiver 140.

A second valve line 142 connects the second port 132 of the condenser/evaporator to the reversing valve 118, to conduct high temperature, high pressure refrigerant from the compressor 108 from the reversing valve 118 the condenser/evaporator 128 during the cooling cycle, and to conduct low temperature low pressure refrigerant gas from the condenser/evaporator coil 128 to the reversing valve 118 during the heating cycle. A third valve line 144 connects the reversing valve to the compressor inlet line 114. The third valve line 144 conducts refrigerant, returned to the reversing valve 118 by the second valve line 142 during the heating cycle, to the compressor inlet line 114, downstream of the valve 116.

An expansion device 146 is provided in first heat exchanger conduit 104, and is bypassed by a check valve 148 so that refrigerant passing from the condenser/evaporator 128 to the heat exchanger 102 during the cooling cycle passes through the expansion device 146, while refrigerant passing in the opposite direction during the heating cycle bypasses expansion device 136.

Figure 3:
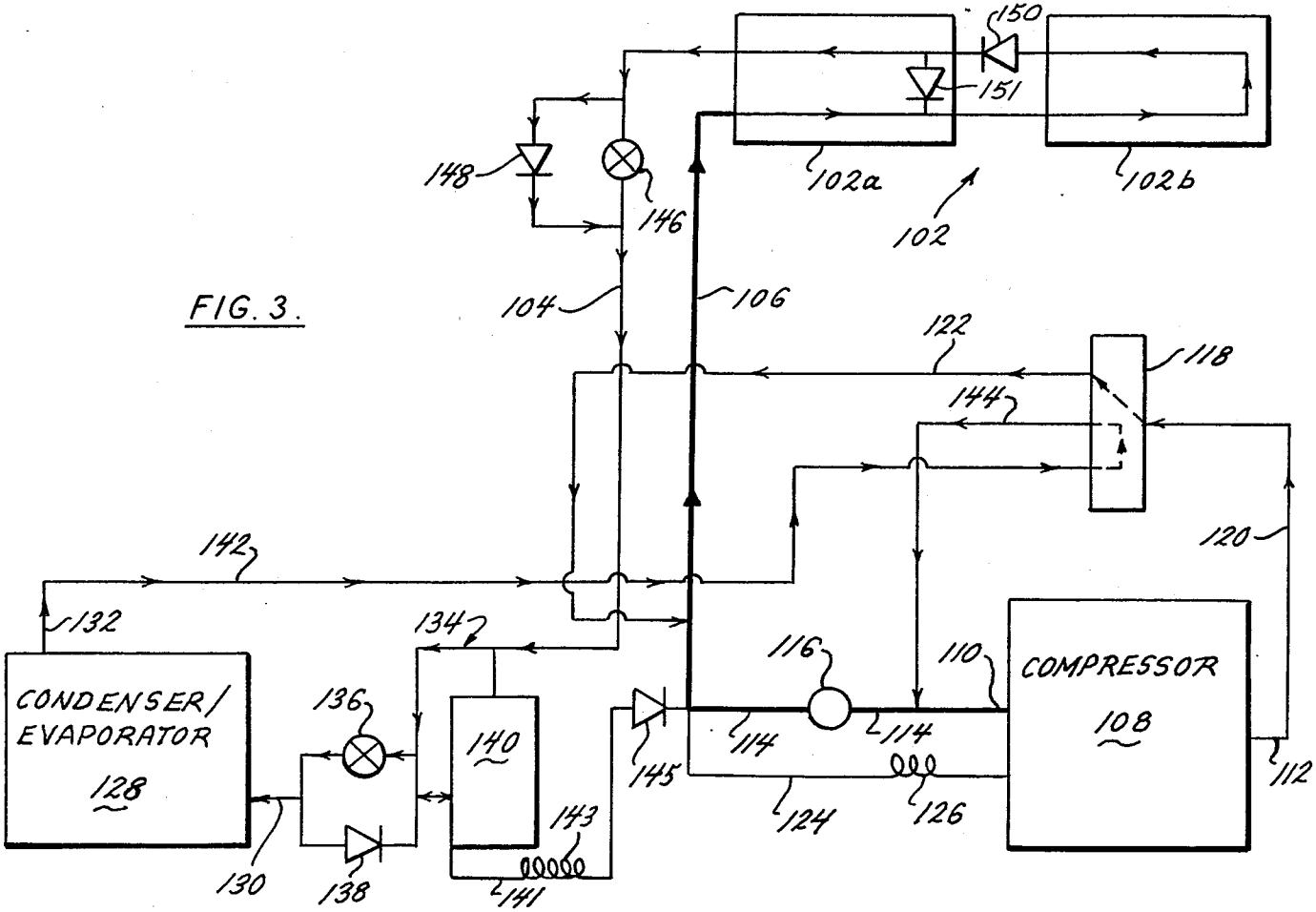
FIG. 3 is a schematic diagram of the heat pump in FIG. 2 during the heating cycle.

As shown in FIG. 3, during the heating cycle, high temperature, high pressure refrigerant gas leaves the outlet 112 of compressor 108, and passes through connector 120 to reversing valve 118. The reversing valve 118 directs the refrigerant through first valve line 122. The refrigerant passes through first valve line 122 to second heat exchanger conduit 106. At this juncture, because of the size difference between first valve line 122 and second heat exchanger conduit 106, the refrigerant decelerates. This deceleration causes any lubricating oil picked up by the refrigerant from the compressor to form droplets. The droplets collect at a low point in second heat exchanger conduit 106. This oil is returned to the compressor by oil scavenger capillary 124.

The refrigerant gas travels through second heat exchanger conduit 106 to heat exchanger 102. Because of the improved efficiency of heat pump 100, the heat exchanger 102 is preferably divided into first and second sections **102*a* and 102*b*, interconnected so that during the heating cycle the refrigerant passes through both first and second sections 102*a* and 102*b*, but so that during the cooling cycle the refrigerant passes only through first section 102a. This may be done with check valves 150 and 151**.

The refrigerant gas circulates through the circuit in heat exchanger 102, giving up heat to air forced over the heat exchanger. The refrigerant condenses and exits the heat exchanger, bypassing expansion device 146 though check valve 148, and passing through first heat exchanger conduit 104 to line 134. The refrigerant then passes through expansion device 136 and passes as a gas into condenser/evaporator 128 through port 130. The refrigerant gas circulates through condenser/evaporator coil 128 absorbing heat and exits from port 132 to line 142. The refrigerant returns in line 142 to the reversing valve 118. The reversing valve 118 channels the refrigerant through line 144 to compressor inlet conduit 114.

Figure 4:
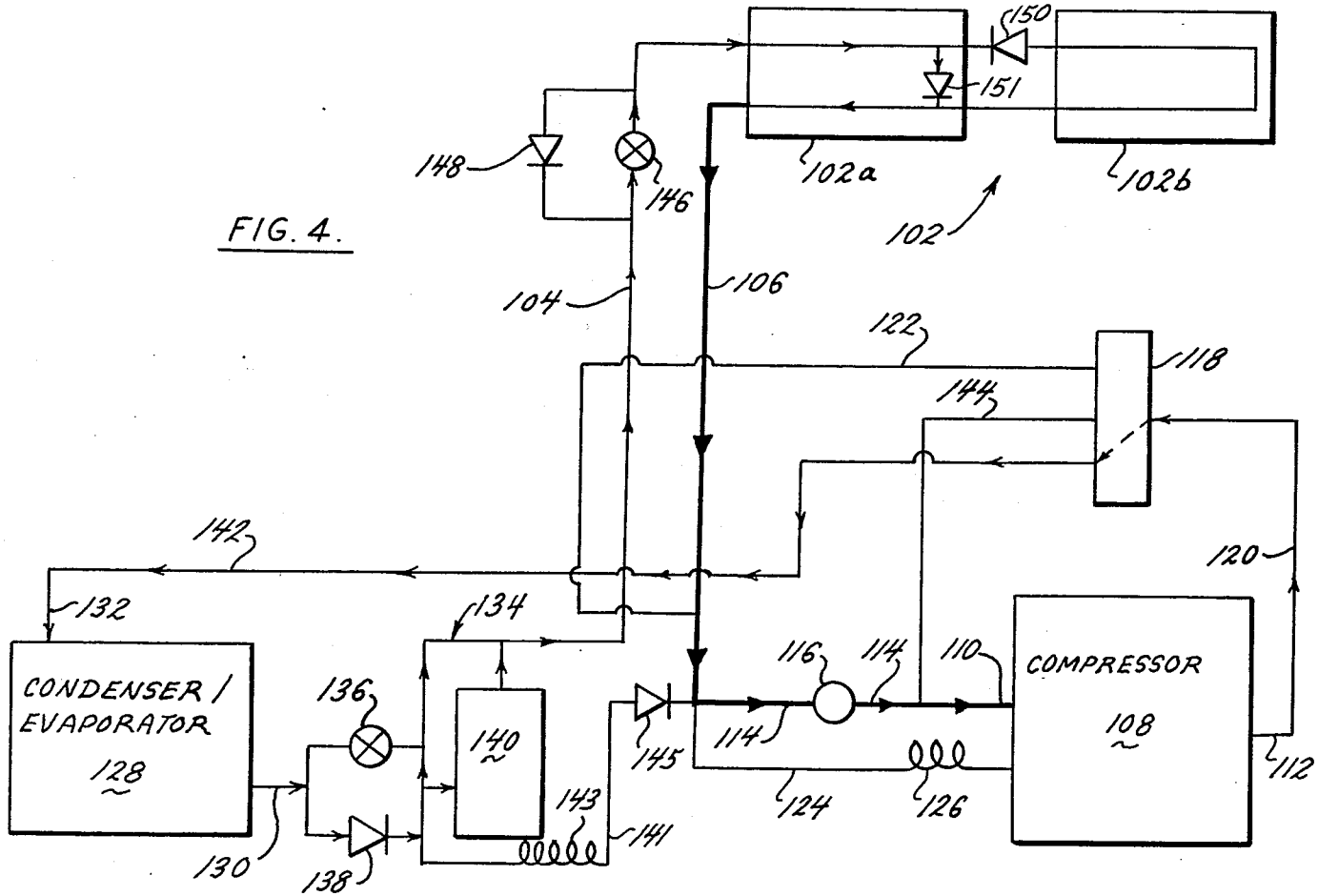
FIG. 4 is a schematic diagram of the heat pump of FIG. 2 during the cooling cycle.

As shown in FIG. 4, during the cooling cycle, high temperature, high pressure refrigerant gas leaves the outlet 112 of compressor 108, and passes through connector 120 to reversing valve 118. The reversing valve 118 directs the refrigerant through second valve line 142. The refrigerant passes through first valve line 142 to the second port 132 of the condenser/evaporator coil 128. The refrigerant circulates through the circuit in condenser/evaporator 128, giving up heat. The refrigerant condenses and exits the condenser/evaporator 128 through the first port 130 to line 134. The refrigerant bypasses expansion device 136 and enters first heat exchanger conduit 104. The refrigerant passes through first heat exchanger conduit 104 and into expansion device 146. The refrigerant is vaporized and exits expansion device 146 and enters heat exchanger 102. As noted above, heat exchanger 102 preferably has two sections 102a and 102b. These sections are configured so that during the cooling cycle the refrigerant only cycles through the first section 102a. This is to prevent the device from short cycling, and to allow for better humidity control by the heat pump 100. If the refrigerant cycled through both heat exchanger sections, the heat pump would operate for only a very short period of time (short cycle) and would not properly control the humidity level. The refrigerant absorbs heat in the heat exchanger 102.

Figure 5:
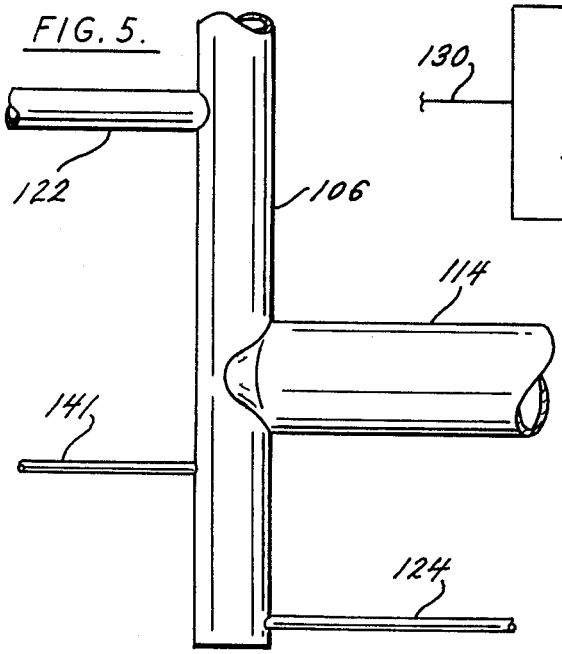
FIG. 5 is a view of a possible configuration of the oil scavenging tube according to the principles of this invention.

The refrigerant gas exits the heat exchanger 102 through the second heat exchanger conduit 106. The refrigerant passes from the second heat exchanger conduit 106 to compressor inlet 114. The valve 116 is open in the cooling cycle, allowing the refrigerant to pass into the inlet 110 of the compressor 108. At the juncture of the second heat exchanger conduit 106 and the compressor inlet conduit 114, the refrigerant decelerates because of the size difference between these conduits. This causes any lubricating oil picked up by the refrigerant from the compressor to form droplets. The droplets collect at a low point in second heat exchanger conduit 106. This oil is returned to the compressor by oil scavenger capillary, FIG. 5 shows the preferred arrangement of the first valve line 122, the second heat exchanger conduit 106 and the compressor inlet 114, and the interconnection of the oil scavenger line 122. As noted above, the capillary 124 preferable has loops 126 which act as a trap.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

I claim:

1. An improved heat pump of the type in which a compressor circulates refrigerant through a closed system to a heat exchanger during heating and cooling cycles to transfer heat to and from air forced over the heat exchanger, the improvement comprising means for removing oil that is picked up by the refrigerant from the compressor, this means comprising:

a size increase in a portion of the closed system which conducts refrigerant during the cooling cycle, the size increase decelerating the refrigerant to cause oil carried by the refrigerant to drop out;

a size increase in a portion of the closed system which conducts refrigerant during the heating cycle, the size increase decelerating the refrigerant to cause oil carried by the refrigerant to drop out;

at least one oil scavenging capillary to return the oil removed by the size increases to the compressor.

2. An improved heat pump of the type in which a compressor circulates refrigerant through a closed system to a heat exchanger during heating and cooling cycles to transfer heat to and from air forced over the heat exchanger, the improvement comprising means for removing oil that is picked up by the refrigerant from the compressor, said means including:

a conduit for conducting refrigerant to the heat exchanger during the heating cycle and conducting refrigerant from the heat exchanger during the cooling cycle;

a first line communicating with the conduit to provide refrigerant to the conduit during the heating cycle, the first line being smaller than the conduit so that as refrigerant passes from the first line to the conduit it decelerates, causing the oil carried by the refrigerant to fall out;

a second line communicating with the conduit to conduct refrigerant from the conduit during the cooling cycle, the second line being larger than the conduit so that as refrigerant passes from the conduit to the second line it decelerates, causing the oil carried by the refrigerant to fall out; and an oil scavenging capillary to return the oil removed in from the refrigerant in the conduit to the compressor.

3. A heat pump adapted to circulate a refrigerant therein during separate heating and cooling cycles to add heat to and removed heat from air, respectively, the heat pump comprising:

a heat exchanger, having a refrigerant circuit therein with first and second ends, adapted to add heat to air passed over it during the heating cycle by conducting heat from refrigerant circulating therein, and adapted to remove heat from air passed over it during the cooling cycle by conducting heat to refrigerant circulating therein;

a first heat exchanger conduit extending from one end of the heat exchanger circuit for conducting refrigerant from the heat exchanger during the heating cycle and for conducting refrigerant to the heat exchanger during the cooling cycle;

a second heat exchanger conduit extending from the other end of the heat exchanger circuit for conducting refrigerant to the heat exchanger during the heating cycle and for conducting refrigerant from the heat exchanger during the cooling cycle;

a compressor for circulating vaporized refrigerant during the heating and cooling cycles, the compressor having an inlet and an outlet;

a first connecting means for connecting the outlet of the compressor to the second heat exchanger conduit during the heating cycle, the first connecting means being of smaller size than the second heat exchanger conduit so that the refrigerant decelerates passing from the first connecting means to the second heat exchanger conduit;

a second connecting means for connecting the second heat exchanger conduit to the compressor inlet during the cooling cycle, the second connecting means being of larger size than the second heat exchanger conduit so that the refrigerant decelerates passing from the second heat exchanger conduit to the second connecting means;

a first oil scavenger tube connecting the second heat exchanger conduit to the compressor, the first oil scavenger tube returning oil introduced into the refrigerant by the compressor and removed from the refrigerant by the deceleration of the refrigerant caused by the first or second connecting means, to the compressor;

a condenser/evaporator coil, having a refrigerant circuit, adapted to add heat to refrigerant circulating therein during the heating cycle and adapted to remove heat from refrigerant circulating therein during the cooling cycle, the refrigerant circuit in the condenser/evaporator coil having first and second ports, refrigerant entering the first port and exiting the second port during the heating cycle and refrigerant entering the second port and exiting the first port during the cooling cycle;

a third connecting means for connecting the first heat exchanger conduit to the first port of the condenser/evaporator coil to conduct refrigerant from the first heat exchanger conduit to the first port of the condenser/evaporator coil during the heating cycle and to conduct refrigerant from the first port of the condenser/evaporator to the first heat exchanger conduit during the cooling cycle;

a fourth connecting means for connecting the second port of the condenser/evaporator to the inlet of the compressor during the heating cycle to conduct refrigerant from the second port of the condenser-/evaporator to the inlet of the compressor; and a fifth connecting means for connecting the second port of the condenser/evaporator to the outlet of the compressor during the cooling cycle to conduct refrigerant from the outlet of the compressor to the second port of the condenser/evaporator.

4. The heat pump according to claim 3 further comprising a second oil scavenger tube in parallel with a portion of the third connecting means to remove oil from the refrigerant.

5. The heat pump according to claim 3 wherein the heat exchanger comprises first and second sections, and means for controlling the flow of refrigerant through the heat exchanger so that refrigerant flows through the first and second sections during the heating cycle and flows only through the first section during the cooling cycle.

6. A heat pump adapted to circulate a refrigerant therein during separate heating and cooling cycles to add heat to and to remove heat from air, respectively, the heat pump comprising:

a heat exchanger, having a refrigerant circuit therein with first and second ends, adapted to add heat to air passed over it during the heating cycle by conducting heat from refrigerant circulating therein, and adapted to remove heat from air passed over it during the cooling cycle by conducting heat to refrigerant circulating therein;

a first heat exchanger conduit extending from one end of the heat exchanger circuit for conducting refrigerant from the heat exchanger during the heating cycle and for conducting refrigerant to the heat exchanger during the cooling cycle;

a second heat exchanger conduit extending from the other end of the heat exchanger conduit for conducting refrigerant to the heat exchanger during the heating cycle and for conducting refrigerant from the heat exchanger to during the cooling cycle;

a compressor for circulating vaporized refrigerant during the heating and cooling cycles, the compressor having an inlet and an outlet;

a compressor inlet conduit between the second heat exchanger conduit and the compressor inlet, and having a valve therein to conduct refrigerant from the second heat exchanger conduit to the compressor inlet during the cooling cycle and to block passage of refrigerant from the second heat exchanger conduit to the compressor inlet during the heating cycle, the compressor inlet conduit being of larger size than the second heat exchanger conduit so that the refrigerant decelerates passing from the second heat exchanger conduit to the compressor inlet conduit;

a reversing valve;

a compressor outlet conduit for conducting refrigerant from the compressor out to the reversing valve;

a first valve line from the reversing valve to the second heat exchanger conduit for conducting refrigerant, supplied from the compressor, to the second conduit during the heating cycle, the first valve line being of smaller size than the second heat exchanger conduit so that the refrigerant decelerates passing from the first valve line to the second heat exchanger conduit;

a first oil scavenger tube connecting the second heat exchanger conduit to the compressor, the first oil scavenger tube returning oil, introduced into the refrigerant by the compressor and removed from the refrigerant by the deceleration of the refrigerant passing from the first exit line to the second heat exchanger conduit during the heating cycle, and by the deceleration of the refrigerant passing from the second heat exchanger conduit to the compressor inlet during the cooling cycle;

a condenser/evaporator coil having a refrigerant circuit therein adapted to add heat to refrigerant circulating therein during the heating cycle and adapted to remove heat from refrigerant circulating therein during the cooling cycle, the refrigerant circuit in the condenser/evaporator coil having first and second ports, refrigerant entering the first port and exiting the second port during the heating cycle and refrigerant entering the second port and exiting the first port during the cooling cycle;

means for connecting the first heat exchanger conduit to the first port of the condenser/evaporator coil to conduct refrigerant from the first heat exchanger conduit to the first port of the condenser/evaporator coil during the heating cycle and to conduct refrigerant from the first port of the condenser-/evaporator coil to the first heat exchanger conduit during the cooling cycle;

a second valve line from the reversing valve to the second port of the condenser/evaporator coil, the second valve line conducting refrigerant, supplied to the reversing valve from the compressor, to the second port of the condenser/evaporator coil during the cooling cycle, and the second line conducting refrigerant from the second port of the condenser/evaporator coil to the reversing valve during the heating cycle;

a third valve line from the reversing valve to the compressor inlet, the third line conducting refrigerant, supplied to the reversing valve by the second reversing valve line during the heating cycle, to the compressor inlet conduit, below the valve therein.

7. The heat pump according to claim 6 wherein the heat exchanger comprises first and second sections, and means for controlling the flow of refrigerant through the heat exchanger so that refrigerant flows through the first and second sections during the heating cycle and flows only through the first section during the cooling cycle.

* * * * *